United States Patent [19]

Brereton

[11] Patent Number: 4,851,099

[45] Date of Patent: Jul. 25, 1989

[54] ELECTROLYTIC CELL

[75] Inventor: Colin Brereton, Middlewich, United Kingdom

[73] Assignee: Imperial Chemical Industries PLC, London, United Kingdom

[21] Appl. No.: 112,892

[22] Filed: Oct. 27, 1987

[30] Foreign Application Priority Data

Nov. 7, 1986 [GB] United Kingdom ..... 8626629

[51] Int. Cl.[4] ..... C25B 13/02; C25B 15/02

[52] U.S. Cl. ..... 204/256; 204/258; 204/266; 204/279

[58] Field of Search ..... 204/256, 258, 266, 265, 204/270, 279, 263–264, 253–255, 257

[56] References Cited

U.S. PATENT DOCUMENTS

| | | | |
|---|---|---|---|
| 1,107,258 | 8/1914 | Burdett | 204/258 |
| 1,548,362 | 8/1925 | Holmboe | 204/258 |
| 3,930,151 | 12/1975 | Shibata et al. | 204/266 X |
| 4,156,639 | 5/1979 | Vallance et al. | 204/266 X |
| 4,464,243 | 8/1984 | Woolhouse | 204/257 |
| 4,484,998 | 11/1984 | Nevin | 204/257 |

FOREIGN PATENT DOCUMENTS

| | | | |
|---|---|---|---|
| 0109789 | 5/1984 | European Pat. Off. . | |
| 858841 | 10/1952 | Fed. Rep. of Germany | 121/13 |
| 1503799 | 3/1978 | United Kingdom . | |
| 1547581 | 6/1979 | United Kingdom . | |

*Primary Examiner*—Donald R. Valentine

*Attorney, Agent, or Firm*—Cushman, Darby & Cushman

[57] ABSTRACT

An electrolytic cell comprising a plurality of anodes and cathodes and a separator positioned between each anode and adjacent cathode to form a plurality of anode compartments and cathode compartments, in which a barrier member is positioned at an upper part of the cell between an anode and an adjacent separator, or between a cathode and an adjacent separator, and which, in operation shields the separator from contact with a gaseous product of electrolysis which may collect in an upper part of the anode compartment, or in an upper part of the cathode compartment. The separator may be an ion-exchange membrane, and the barrier member protects the separator from chemical attach by gaseous products of electrolysis.

11 Claims, 8 Drawing Sheets

ELECTROLYTIC CELL

Figure 1:
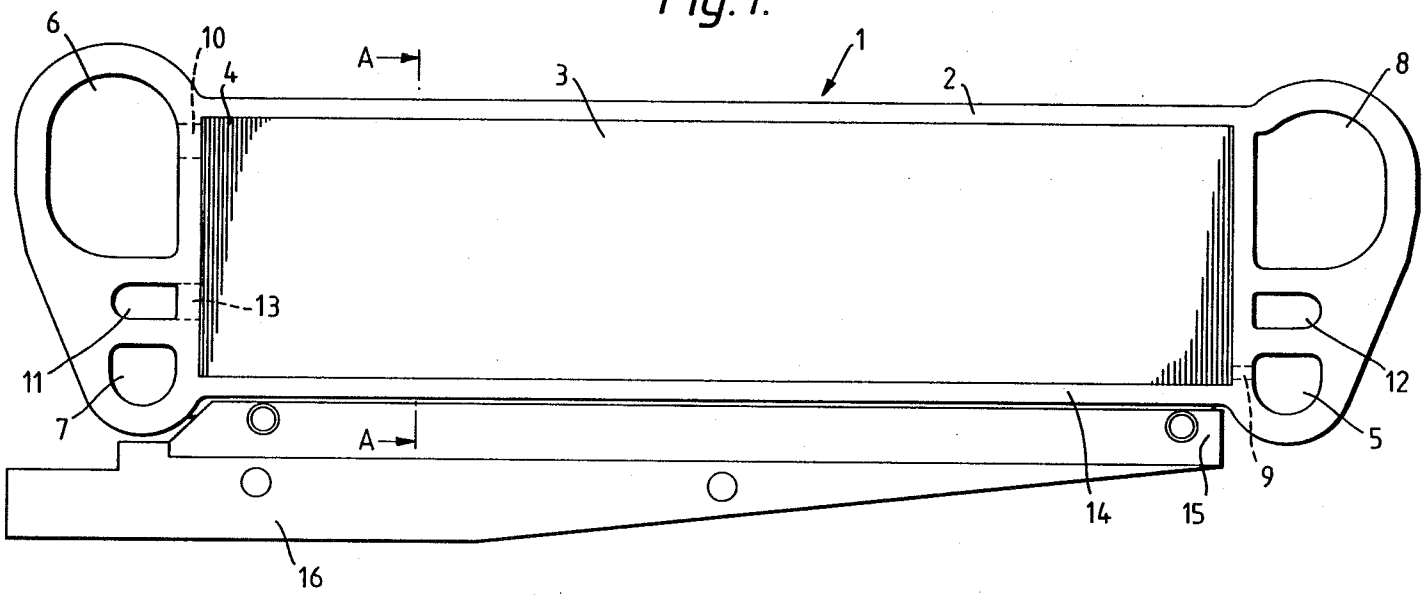

This invention relates to an electrolytic cell, and in particular to an electrolytic cell of the type which comprises a plurality of anodes and cathodes with each anode being separated from the adjacent cathode by a separator which divides the electrolytic cell into a plurality of anode and cathode compartments.

The electrolytic cell may be of the diaphragm type or of the ion-exchange membrane type. In the diaphragm type cell the separators positioned between adjacent anodes and cathodes are microporous and hydraulically permeable and in use the electrolyte passes through the diaphragms from the anode compartments to the cathode compartments of the cell. In the membrane type cell the separators are essentially hydraulically impermeable but are ionically permselective and in use ionic species are transported across the membranes between the anode compartments and the cathode compartments of the cell.

The electrolytic cell of the invention is particularly suitable for use in the electrolysis of an electrolyte in which, as a result of electrolysis, a gaseous product is produced. For example, where an aqueous solution of an alkali metal chloride is electrolysed in an electrolytic cell of the diaphragm type the solution is fed to the anode compartments of the cell, gaseous chlorine which is produced in the electrolysis is removed from the anode compartments of the cell, the alkali metal chloride solution passes through the diaphragms and gaseous hydrogen and alkali metal hydroxide produced by electrolysis are removed from the cathode compartments, the alkali metal hydroxide being removed in the form of an aqueous solution of alkali metal chloride and alkali metal hydroxide. Where an aqueous alkali metal chloride solution is electrolysed in an electrolytic cell of the membrane type which contains a cation-exchange membrane the solution is fed to the anode compartments of the cell and gaseous chlorine produced in the electrolysis and depleted alkali metal chloride solution are removed from the anode compartments, alkali metal ions are transported across the membranes to the cathode compartments of the cell to which water or dilute alkali metal hydroxide solution may be fed, and gaseous hydrogen and alkali metal hydroxide solution produced by the reaction of alkali metal ions with water are removed from the cathode compartments of the cell.

The electrolytic cell of the invention may be of the filter press type which comprises a large number of alternating anodes and cathodes, for example, fifty anodes alternating with fifty cathodes, although the cell may comprise even more anodes and cathodes, for example up to one hundred and fifty alternating anodes and cathodes. The cell may be of the monopolar type or the bipolar type. The electrolytic cell of the invention is not, however, limited to cells of the filter press type, although it is particularly adapted to overcome a problem associated with electrolytic cells of this type. Also, although the invention is applicable to electrolytic cells which contain a hydraulically permeable diaphragm as separator it is particularly adapted to overcome a problem associated with electrolytic cells in which the separator is an ion-exchange membrane.

The aforementioned problem may best be described by reference to an electrolytic cell of the ion-exchange membrane type in which an aqueous solution of an alkali metal chloride is electrolysed. The electrolytic cell may, of course, be used in the electrolysis of other electrolytes.

Such an electrolytic cell may comprise a large number of alternating anodes and cathodes with, in the case of a monopolar cell, a cation-exchange membrane positioned between each anode and adjacent cathode, and in the case of a bipolar cell a cation-exchange membrane positioned between an anode of a bipolar electrode and a cathode of an adjacent bipolar electrode, thereby dividing the cell into a plurality of separate anode and cathode compartments. The anodes, cathodes and membranes will generally be positioned substantially vertically. The cell may be equipped with a header through which aqueous alkali metal chloride solution is charged to the anode compartments, and with a header through which water or dilute aqueous alkali metal hydroxide solution is charged to the cathode compartments. These headers will in general be positioned so that the solutions are charged to a lower part of the anode and cathode compartments, for example, near to the bases of the compartments. The cell may be equipped with a header through which the product of electrolysis, that is chlorine gas and depleted alkali metal chloride solution, may be removed from the anode compartments, and with a header through which the product of electrolysis, that is hydrogen gas and aqueous alkali metal hydroxide solution, may be removed from the cathode compartments. As the gaseous products of electrolysis, that is chlorine and hydrogen, will rise to the top of the anode compartments and cathode compartments respectively, these headers will in general be so positioned that the products of electrolysis are removed from an upper part of the compartments, e.g. from a position at or near to the tops of the compartments. Indeed, the headers may be positioned above the anode and cathode compartments so that the products of electrolysis pass upwardly and out of the compartments and into the headers, the upward passage being assisted by the gas lift effect provided by the gaseous chlorine and hydrogen.

Although the headers for removal of the products of electrolysis may be positioned above the anode and cathode compartments it is frequently the case that a gaseous product of electrolysis cannot be removed sufficiently rapidly to prevent the gaseous product collecting at the upper part of the anode compartment or cathode compartment. This is particularly the case where gaseous products are generated rapidly, that is where the electrolytic cell is operated at high current density. For example, in the case where an aqueous alkali metal chloride solution is electrolysed it is often the case that chlorine gas, e.g. in the form of a foam of gaseous chlorine and alkali metal chloride solution, collects at an upper part of the anode compartments of the cell. This is especially the case with electrolytic cells of the filter press type in which the anode and cathode compartments are relatively narrow. This gaseous chlorine presents a problem which it is difficult to avoid. The chlorine is corrosive, particularly when in the form of a foam as described, and where a pocket of gaseous chlorine which has collected at an upper part of the anode compartment is in contact with a cation-exchange membrane there may be chemical attack on the membrane such that the membrane rapidly becomes unusable, even where the membrane is of the perfluoro-polymer type which is a type which might be expected to be stable. It thus becomes necessary to replace the membrane at more frequent intervals than would otherwise be necessary.

The present invention relates to an electrolytic cell which is so constructed that the effect of the above-described problem is substantially reduced or even eliminated.

There are many prior disclosures of electrolytic cells which contain a cation-exchange membrane and which are of the filter press type.

Thus, in GB Patent No. 1503799 there is described a bipolar electrolytic cell of the filter press type which comprises a plurality of vertically positioned partition walls of an explosion bonded titanium plate and iron plate which divide the cell into a plurality of anode compartments and cathode compartments, a titanium anode electrically connected to each titanium plate, an iron cathode electrically connected to each iron plate, a cation-exchange membrane positioned between each anode and adjacent cathode, supply nozzles at the base of the cell for supply of electrolyte to the anode and cathode compartments of the cell, and discharge nozzles at the top of the cell for removal of the products of electrolysis from the anode and cathode compartments.

In European Patent No. 45148 there is described a monopolar electrolytic cell of the filter press type which comprises a plurality of vertically positioned anodes and cathodes with gaskets of an electrically insulating material and a cation-exchange membrane positioned between each anode and adjacent cathode thereby electrically insulating each anode from the adjacent cathode and also dividing the cell into a plurality of anode compartments and cathode compartments. The anodes and cathodes each have an active surface which comprises a plurality of spaced-apart strips which are displaced from and parallel to a support member, and the headers through which the electrolyte is charged to, and through which the products of electrolysis are removed from the anode compartments and cathode compartments, are provided by openings in the anodes, cathodes and gaskets which in the cell cooperate with each other to form the headers.

The present invention provides an electrolytic cell comprising a plurality of substantially vertically positioned electrodes and a separator positioned between adjacent pairs of electrodes thereby dividing the cell into a plurality of separate electrode compartments, in which a barrier member is positioned at an upper part of an electrode compartment between an electrode and an adjacent separator which barrier number, in operation of the electrolytic cell, shields the separator from contact with a gaseous product of electrolysis which may collect in an upper part of the electrode compartment.

The electrolytic cell of the invention may be an electrolytic cell comprising a plurality of substantially vertically positioned anodes and cathodes and a separator positioned between each anode and adjacent cathode thereby dividing the cell into a plurality of anode compartments and cathode compartments, in which a barrier member is positioned at an upper part of an anode compartment of the cell between an anode and an adjacent separator, or at an upper part of a cathode compartment of the cell between a cathode and an adjacent separator, which barrier member, in operation of the electrolytic cell, shields the separator from contact with a gaseous product of electrolysis which may collect in an upper part of the anode compartment, or in an upper part of the cathode compartment.

The electrolytic cell of the invention may be a monopolar cell which comprises a plurality of alternating anodes and cathodes with a separator being positioned between each anode and adjacent cathode, or it may be a bipolar cell which comprises a plurality of bipolar electrodes one face of which functions as an anode and an opposite face of which functions as a cathode and in which a separator is positioned between an anode of one bipolar electrode and a cathode of an adjacent bipolar electrode.

In the electrolytic cell the anodes and cathodes are substantially vertically positioned. It is not necessary that the anodes and cathodes be positioned precisely vertically. All that is required is that the anodes and cathodes be so positioned that in operation of the cell a gaseous product of electrolysis rises to the top of an anode compartment, or to the top of a cathode compartment, and thus the anodes and cathodes may be so positioned that they are inclined at a substantial angle to a vertical position. The anodes and cathodes should not be horizontally positioned.

In operation of the electrolytic cell a gaseous product of electrolysis may collect in an upper part of an electrode compartment of the cell, which may be an anode compartment or a cathode compartment. In order to shield the separator from the gaseous product in the electrode compartment the barrier member preferably extends for substantially the full width of the compartment.

The depth of the barrier member will depend on the amount of gaseous product in the electrode compartment and on the level of the liquid in the electrode compartment. Although the level of the liquid in the electode compartment may not be susceptible of precise determination due in part to the presence of the gaseous product in the form of a foam with the liquid in the electrode compartment the barrier member preferably has sufficient depth that is shields the separator from substantially all of the gaseous product of electrolysis which may collect in an upper part of the electrode compartment. It is impossible to place a precise figure on this preferred depth of the barrier member as the amount of gaseous product of electrolysis which collects in the electrode compartment depends on a number of factors, including various constructional features of the cell and on the rate at which the gaseous product is produced.

The preferred features of the barrier member hereinbefore described with respect to a barrier member positioned between an electrode an an adjacent separator are applicable both to a barrier member positioned between an anode and an adjacent separator and to a barrier member positioned between a cathode an an adjacent separator. Indeed, the electrolytic cell may comprise a barrier member positioned between an anode and an adjacent separator and a barrier member positioned between a cathode and an adjacent separator. Whether or not such a positioning of barrier members is desirable, or necessary, depends upon the nature of the gaseous products of electrolysis. For example, in an electrolytic cell in which an aqueous alkali metal chloride solution is electrolysed corrosive gaseous chlorine is produced in the anode compartments of the cell and a barrier member is desirable, or even necessary, positioned between an anode and an adjacent separator in an upper part of an anode compartment of the cell in order to shield the separator from contact with the corrosive gaseous chlorine. On the other hand, in such electrolysis gaseous hydrogen, which is not corrosive, is produced in the cathode compartments of the cell and in this case it may not be necessary to position a barrier member between a cathode and an adjacent separator in an upper part of a cathode compartment of the cell. However, the cathode compartments may contain such barrier members.

It will be appreciated that due to the presence of the barrier member the separator is shielded from contact with corrosive gaseous products of electrolysis with the result that the active life of the separator is longer than it would otherwise have been.

The invention has particular applicability to electrolytic cells of the filter press type. An electrolytic cell of this type may comprise, for example, a plurality of anodes, cathodes and frame-like gaskets of an electrically insulating material in which the anodes and cathodes are positioned in recesses in the frame-like gaskets, or alternatively the frame-like gaskets may be positioned between each anode and adjacent cathode thereby electrically insulating each anode from an adjacent cathode. The frame-like gasket may comprise a central opening and the barrier member may be positioned across the central opening such that in the cell the barrier member is positioned at an upper part of the cell between an electrode and an adjacent separator.

The barrier member may be integral with the gasket, that is it may be formed integrally with the gasket. Alternatively, the barrier member may be attached to the gasket, e.g. by means of an adhesive.

In the electrolytic cell the gaskets are made of an electrically insultaing material. It is desirable that the gaskets are flexible, and preferably resilient, in order to aid in achieving leak-tight seals in the electrolytic cell.

The gaskets are suitably made of an organic polymeric material which material may be, for example, a polyolefin, e.g. polyethylene or polypropylene; a hydrocarbon elastomer, e.g. an elastomer based on ethylene-propylene copolymer, an ethylene-propylenediene copolymer, natural rubber or a styrene butadiene rubber; or a chlorinated hydrocarbon, e.g. polyvinyl chloride or polyvinylidene chloride. It is particularly desirable that the material of the gasket be chemically resistant to the liquors in the electrolytic cell, and when the cell is to be used in the electrolysis of aqueous alkali metal chloride solution the material may be a fluorinated polymeric material, for example polytetrafluoroethylene, polyvinyl fluoride, polyvinylidene fluoride, fluorinated ethylene-propylene copolymer, or a substrate having an outer layer of such a fluorinated polymeric material.

The barrier member may be made of the same material of the gasket, particularly when the gasket and barrier material are of unitary construction. Alternatively, the barrier member may be made of a material different from that of the gasket, or at least it may have a coating of a different material. This is particularly suitable where the barrier member is to be contacted with a particularly corrosive gaseous product, e.g. chlorine. In this case the barrier member may be made of, or be coated with, a fluoropolymeric material.

The electrodes in the electrolytic cell will generally be made of a metal or alloy and the nature of the metal or alloy will depend on whether the electrode is to be used as an anode or cathode and on the nature of the electrolyte which is to be electrolysed in the electrolytic cell.

For example, where aqueous alkali metal chloride solution is to be electrolysed the anode is suitably made of a film-forming metal or an alloy thereof, for example of zirconium, niobium, tungsten or tantalum, but preferably of titanium, and the surface of the anode suitably carries a coating of an electro-conducting electrocatalytically active material. The coating may comprise one or more platinum group metals, that is platinum, rhodium, iridium, ruthenium, osmium or palladium, and/or an oxide of one or more of these metals. The coating of platinum group metal and/or oxide may be present in admixture with one or more non-noble metal oxides, e.g. titanium dioxide, particularly in the form of a solid solution of the oxides.

Electro-conducting electrocatalytically active material for use as anode coatings in an electrolytic cell for the electrolysis of aqueous alkali metal chloride solution, and the methods of application of such coatings, are well known in the art.

Where aqueous alkali metal chloride solution is to be electrolysed the cathode is suitably made of iron or steel, or of other suitable metal, for example, nickel. The cathode may be coated with a material designed to reduce the hydrogen overpotential of the electrolysis.

The electrode may, at least in part, have a foraminate surface, for example, it may be in the form of a perforated plate, or it may have a mesh surface or surfaces, e.g. a woven mesh, or it may comprise a plurality of spaced apart elongated members, e.g. a plurality of strips, which will generally be parallel to each other and vertically disposed in the electrolytic cell. Indeed, a foraminate surface which comprises a plurality of elongated members shows certain advantages where the separator in the electrolytic cell is an ion-exchange membrane. Thus, ion-exchange membranes expand when contacted with electrolyte in the cell and the spaces between the elongated members provide spaces into which the membrane may expand without damage to the membrane.

The electrolytic cell contains a separator positioned between each anode and adjacent cathode, or between each anode of a bipolar electrode and an adjacent cathode of a bipolar electrode thereby diving the cell into a plurality of separate anode and cathode compartments. The separator may be a porous hydraulically permeable diaphragm or a substantially hydraulically impermeable ion-exchange membrane. In the assembled electrolytic cell the separator may be positioned between adjacent gaskets and held in position by the compressive force exerted in the final stages of assembly of the electrolytic cell. During assembly of the electrolytic cell the separator may be attached to a gasket by any convenient means, for example, by means of an adhesive.

Where the electrolytic cell contains a separator which is a porous diaphragm the nature of the diaphragm will depend on the nature of the electrolyte which is to be electrolysed in the cell. The diaphragm should be resistant to degradation by the electrolyte and by the products of electrolysis and, where an aqueous solution of alkali metal chloride is to be electrolysed, the diaphragm is suitably made of a fluorine-containing polymeric material as such materials are generally resistant to degradation by the chlorine and alkali metal hydroxide produced in the electrolysis. Preferably, the porous diaphragm is made of polytetrafluoroethylene, although other materials which may be used include, for example, tetrafluoroethylene—hexafluoropropylene copolymers, and fluorinated ethylene—propylene copolymers.

Suitable porous diaphragms are those described, for example, in UK Patent No. 1503915 in which there is described a porous diaphragm of polytetrafluoroethylene having a microstructure of nodes interconnected by fibrils, and in UK Patent No. 1081046 in which there is described a porous diaphragm produced by extracting a particulate filler from a sheet of polytetrafluoroethylene. Other suitable diaphragms are described in the art.

Where the separator to be used in the electrolytic cell is a cation-exchange membrane the nature of the mebrane will also depend on the nature of the electrolyte which is to be electrolysed in the cell. The membrane should be resistant to degradation by the electrolyte and by the products of electrolysis and, where an aqueous solution of alkali metal chloride is to be electrolysed, the membrane is suitably made of a fluorine-containing polymeric material containing cation-exchange groups, for example, sulphonic acid, carboxylic acid or phosphonic acid groups, or derivatives thereof, or a mixture of two or more such groups.

Suitable cation-exchange membranes are those described for example, in UK Patent Nos. 1184321, 1402920, 14066673, 1455070, 1497748, 1497749, 1518387 and 1531068.

In the electrolytic cell the anode compartments will be provided with means for feeding electrolyte to the compartments, suitably from a common header, and with means for removing products of electrolysis from the compartments. Similarly, the cathode compartments of the cell will be provided with means for removing products of electrolysis from the compartments, and optionally with means for feeding water or other liquor to the compartments, suitably form a common header.

For example, where the cell is to be used in the electrolysis of aqueous alkali metal chloride solution the cell will be provided with means for feeding the aqeuous alkali metal chloride solution to the anode compartments of the cell and with means for removing chlorine and depleted aqueous alkali metal chloride solution from the anode compartments, and the cell will be provided with means for removing hydrogen and cell liquor containing alkali metal hydroxide from the cathode compartments, and optionally, and if necessary, with means for feeding water or dilute alkali metal hydroxide solution to the cathode compartments.

In the electrolytic cell the individual anode compartments of the cell will be provided with means for feeding electrolyte to the compartments, suitably from a common header, and with means for removing products of electrolysis from the compartments. Similarly the individual cathode compartments of the cell will be provided with means for removing products of electrolysis from the compartments, and optionally with means for feeding water or other liquor to the compartments, suitably from a common header.

Although it is possible for the means for feeding electrolyte and for removing products of electrolysis to be provided by separate pipes leading to or from each of the respective anode and cathode compartments in the cell such an arrangement may be unnecessarily complicated and cumbersome, particularly in an electrolytic cell of the filter press type which may comprise a large number of such compartments. In a preferred type of electrolytic cell the gaskets, and optionally the electrodes, have a plurality of openings therein which in the cell define separate compartments lengthwise of the cell which serve as headers and through which the electrolyte may be fed to the cell, e.g. to the anode compartments of the cell, and through which the products of electrolysis may be removed from the cell, e.g. from the anode and cathode compartments of the cell. The compartments lengthwise of the cell which serve as headers may communicate with the anode compartments and cathode compartments of the cell via channels in the electrodes, e.g. in the faces of the electrodes, or by channels in the gaskets, e.g. in the faces of the gaskets.

Where the electrolytic cell comprises hydraulically permeable diaphragms there may be two or three openings which define two or three compartments lengthwise of the cell which serve as headers from which electrolyte may be fed to the anode compartments of the cell and through which the products of electrolysis may be removed from anode and cathode compartments of the cell.

Where the electrolytic cell comprises cation-permselective membranes there may be four openings which define four compartments lengthwise of the cell which serve as headers from which electrolyte and water or other fluid may be fed respectively to the anode and cathode compartments of the cell and through which the products of electrolysis may be removed from the anode and cathode compartments of the cell.

The electrolytic cell may be assembled, for example, by positioning the component parts of the cell, that is the anodes, cathodes and gaskets, on tie rods and compressing the component parts between end plates. The component parts may have suitable holes designed to receive the tie rods. Alternatively, the component parts may have pairs of jaws and the cell may be assembled by positioning the jaws onto support rods, the component parts then being compressed between end plates.

Although the electrolytic cell may be used in the electrolysis of a wide variety of electrolytes it is particularly suitable for use in the electrolysis of aqueous alkali metal chloride solution to produce chlorine and aqueous alkali metal hydroxide solution, particularly chlorine and sodium hydroxide solution. Where such a solution is electrolysed in an electrolytic cell of the diaphragm type the solution is fed to the anode compartments of the cell, chlorine which is produced in the electrolysis is removed from the anode compartments of the cell, the alkali metal chloride solution passes through the diaphragms and hydrogen and alkali metal hydroxide produced by electrolysis are removed from the cathode compartments, the alkali metal hydroxide being removed in the form of an aqeuous solution of alkali metal chloride and alkali metal hydroxide.

Where an aqueous alkali metal chloride solution is electrolysed in an electrolytic cell of the membrane type containing a cation permselective membrane the solution is fed to the anode compartments of the cell and chlorine produced in the electrolysis and depleted alkali metal chloride solution are removed from the anode compartments, alkali metal ions are transported across the membranes to the cathode compartments of the cell to which water or dilute aqueous alkali metal hydroxide solution is charged and hydrogen and aqueous alkali metal hydroxide solution produced by the reaction of alkali metal ions with water are removed from the cathode compartments of the cell.

The invention is illustrated by the following embodiment in which

Figure 2:
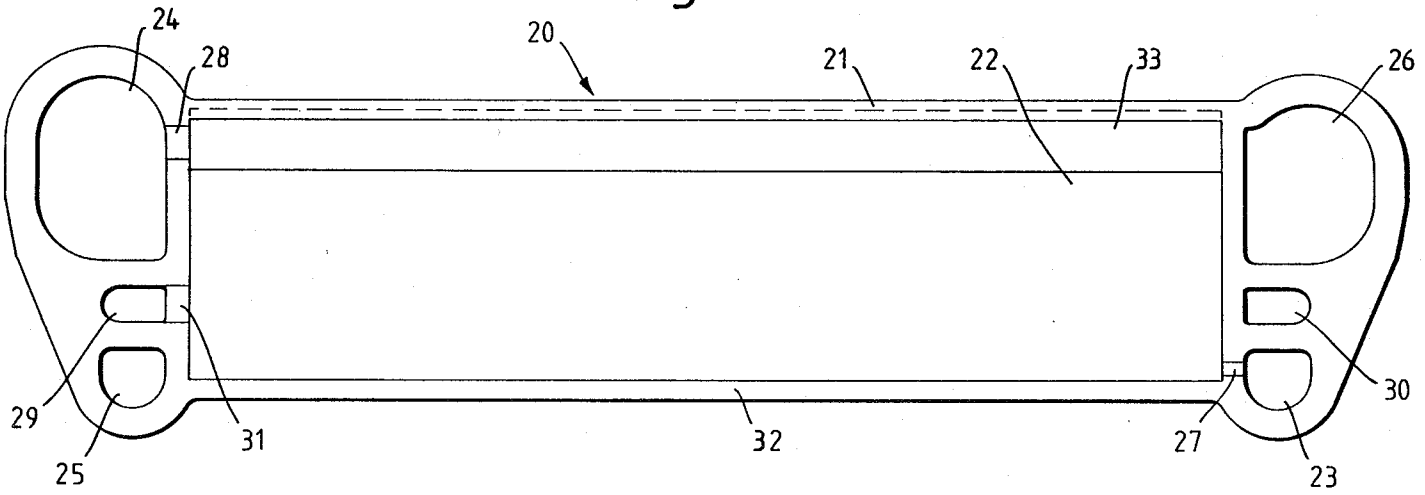
Figure 3:
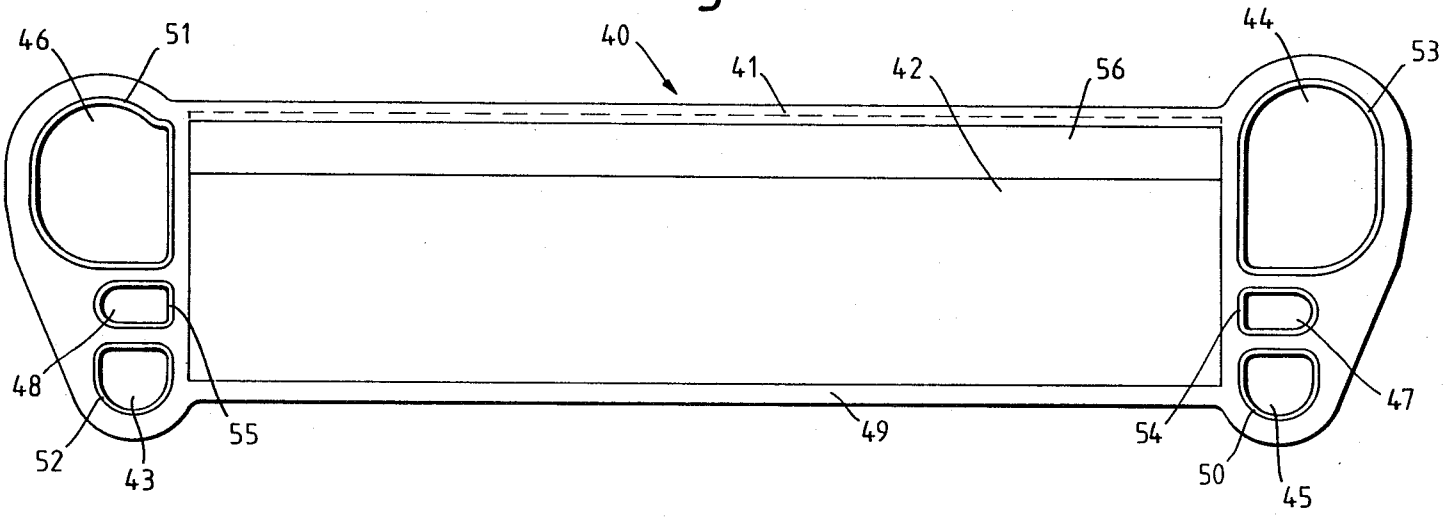
Figure 4:
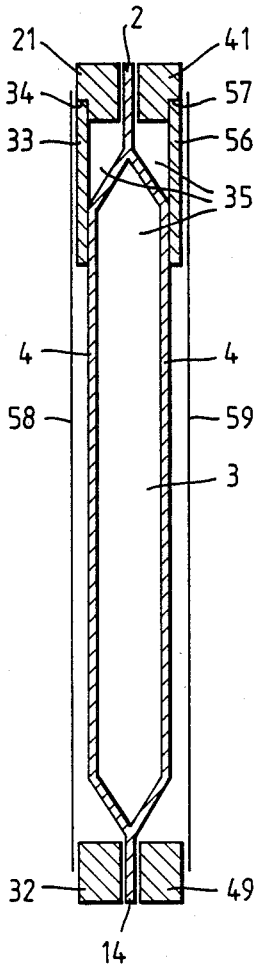
Figure 8:
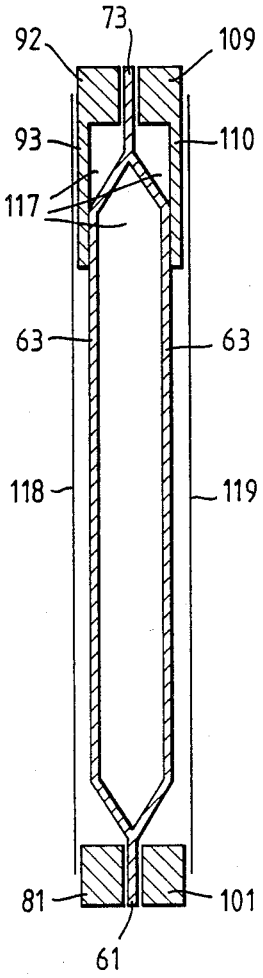
Figure 5:
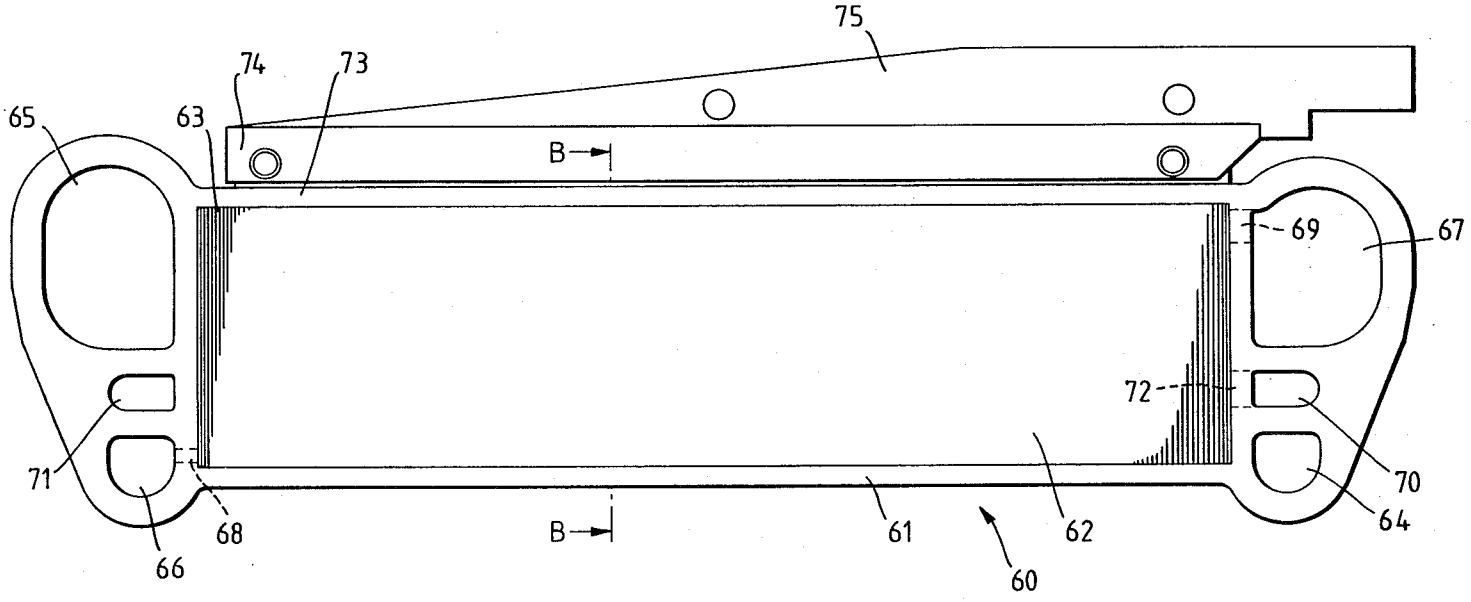
Figure 6:
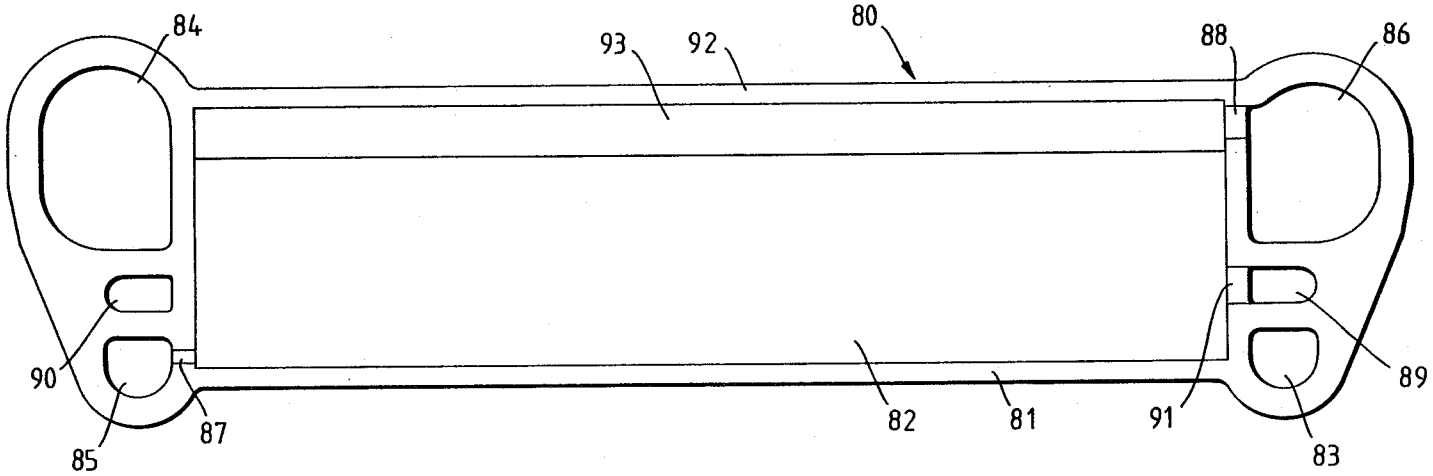
Figure 7:
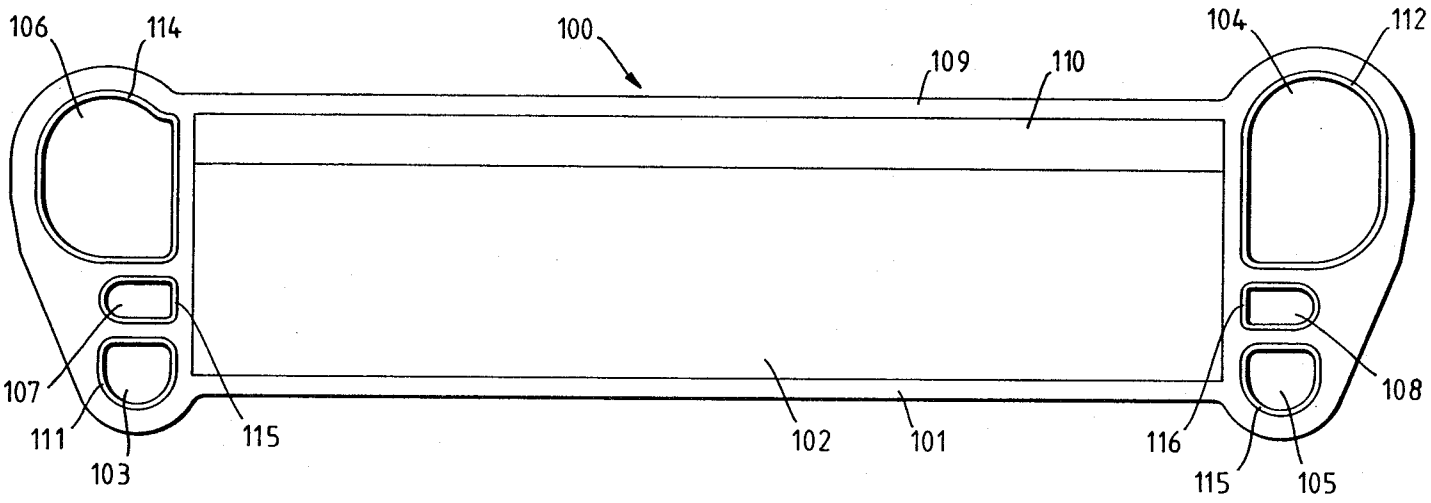
Figure 9:
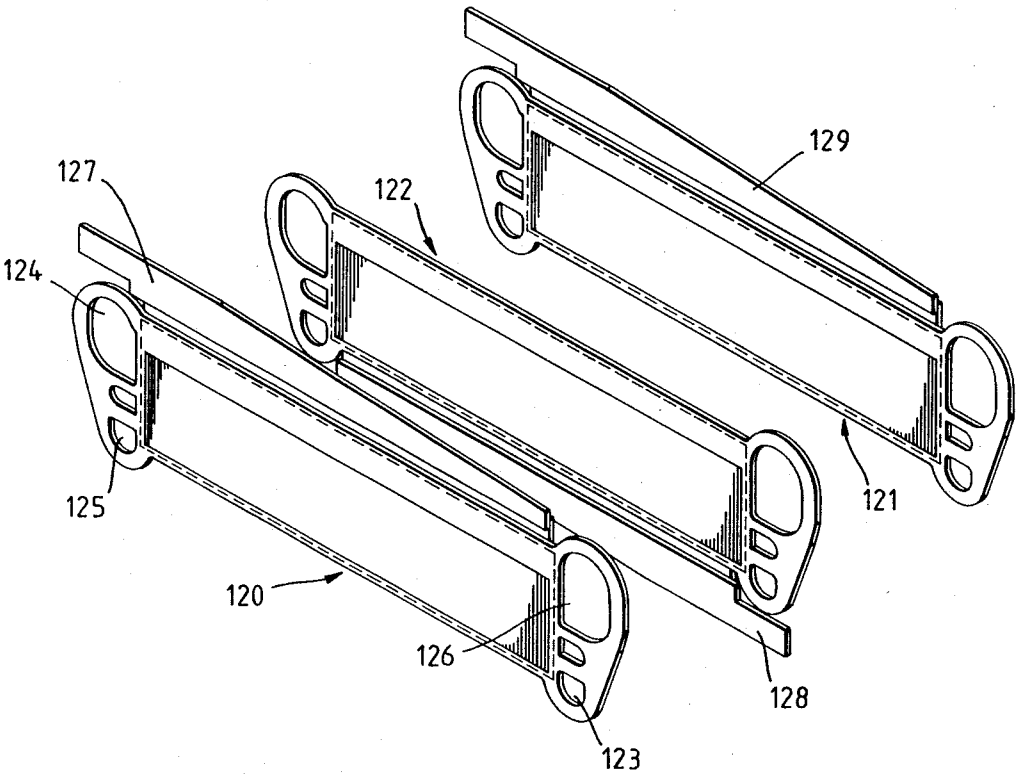

FIG. 1 is a view in elevation of an anode for an electrolytic cell,

FIG. 2 is a view in elevation of a first gasket for attachment to the anode of FIG. 1, FIG. 3 is a view in elevation of a second gasket for attachment to the anode of FIG. 1, FIG. 4 is a cross-sectional view along the line A—A of FIG. 1 and shows the gaskets of FIGS. 2 and 3 attached to the anode of FIG. 1, FIG. 5 is a view in elevation of a cathode for an electrolytic cell, FIG. 6 is a view in elevation of a first gasket for attachment to the cathode of FIG. 5, FIG. 7 is a view in elevation of a second gasket for attachment for the cathode of FIG. 5, FIG. 8 is a cross-sectional view along the line B—B of FIG. 5 and shows the gaskets of FIGS. 6 and 7 attached to the cathode of FIG. 5, and FIG. 9 is an isometric exploded view of a part of the electrolytic cell.

Referring to FIG. 1 the anode 1, which is made of titanium, comprises a frame-like sections 2, 14 defining a central opening 3 which is bridged by a plurality of spaced-apart strips 4 which are parallel to each other, which are displaced from and parallel to the plane of the frame-like sections 2, 14 and which are displaced to both sides of the plane of the frame-like sections 2, 14. The anode 1 comprises four openings 5, 6, 7 and 8 which, in the electrolytic cell, form a part of headers through which, respectively electrolyte is charged to the anode compartments of the electrolytic cell, products of electrolysis are removed from the anode compartment of the cell, water or other liquor is charged to the cathode compartments of the cell, and products of electrolysis are removed from the cathode compartments of the cell. The central opening 3 is connected to the opening 5, and thus to the header through which electrolyte is charged to the anode compartments of the cell, via a port device 9, and the central opening 3 is connected to the opening 6, and thus to the header through which products of electrolysis are removed from the anode compartments of the cell, via a port device 10. The anode 1 comprises two further openings 11 and 12 which in the electrolytic cell form a part of balancing headers which are in communication with, respectively, the anode compartments and the cathode compartments of the cell. The opening 11, and thus the balancing header of which opening 11 forms a part, is connected via port device 13 to the central opening 3 and thus to the anode compartments of the cell. The anode 1 is completed by a projection 15 to which is bolted a copper member 16 through which in operation electrical power is fed to the anode 1.

Referring to FIG. 2 the gasket 20, which is made of an electrically insulating elastomeric material, comprises a frame-like sections 21, 32 defining a central opening 22 and four openings 23, 24, 25, 26 which, in the electrolytic cell, form a part of headers through which, respectively, electrolyte is charged to the anode compartments of the electrolytic cell, products of electrolysis are removed from the anode compartments of the cell, water or other liquor is charged to the cathode compartments of the cell, and products of electrolysis are removed from the cathode compartments of the cell. The central opening 22 is connected to the opening 23, and thus to the header through which electrolyte is charged to the anode compartments of the cell, via a recess 27, and the central opening 22 is connected to the opening 24, and thus to the header through which products of electrolysis are removed from the anode compartments of the cell, via a recess 28. The gasket 20 comprises two further openings 29, 30 which in the electrolytic cell form a part of balancing headers which are in communication with, respectively, the anode compartments and the cathode compartments of the cell. The opening 29, and thus the balancing header of which opening 29 forms a part, is connected via recess 31 to the central opening 22 and thus to the anode compartments of the cell. The gasket 20 is completed by a barrier member 33 which is fitted into a recess 34 (see FIG. 4) in the frame-like section 21 of gasket 20 and is bonded thereto by means of a suitable adhesive. In an electrolytic cell for the electrolysis of aqueous alkali metal chloride solution the barrier member 33 is suitably a fluoropolymer, e.g. fluorinated ethylene-propylene copolymer, which is resistant to corrosion by chlorine which in operation of the cell collects in the upper part 35 of the anode compartment of the cell (see FIG. 4).

Referring to FIG. 3 the gasket 40, which is made of an electrically insulating material, comprises a frame-like section 41, 49 defining a central opening 42 and four openings 43, 44, 45, 46 which, in the electrolytic cell, form a part of headers through which, respectively, electrolyte is charged to the anode compartments of the electrolytic cell, products of electrolysis are removed from the anode compartments of the cell, water or other liquor is charged to the cathode compartments of the cell, and products of electrolysis are removed from the cathode compartments of the cell. The gasket 40 comprises two further openings 47, 48 which in the electrolytic cell form a part of balancing headers which are in communication with, respectively, the anode compartments and the cathode compartments of the cell, and upstanding lips 50, 51, 52, 53, 54, 55 positioned around the openings 45, 46, 43, 44, 47, 48 respectively, the height of these lips from the plane of the gasket 40 being slightly greater than the thickness of the anode 1. The gasket 40 is completed by a barrier member 56 of the same material as barrier member 33 which is fitted into a recess 57 (see FIG. 4) in the frame-like section 41 of gasket 40 and is bonded thereto by means of a suitable adhesive.

The anode 1, gasket 20 and gasket 40 are assembled by positioning a face of anode 1 into contact with gasket 20 with port devices 9, 10 and 13 being positioned in recesses 27, 28 and 31 respectively of gasket 20. Gasket 40 is then positioned in contact with the other face of anode 1 with the upstanding lips 50, 51, 52, 53, 54, 55 being positioned in openings 7, 8, 5, 6, 11, 12 respectively with the lips being in contact with the face of the gasket 20 thus providing a layer of an electrically insulating material around the openings 7, 8, 5, 6, 11, 12.

In order to locate and maintain the gaskets 20, 40 in position in relation to the anode 1 both the gaskets and the anode may comprise a plurality of projections and recesses on and in the faces thereof which mate with each other. For simplicity these projections and recesses are not shown.

Referring to FIG. 4, the positions of two cation-exchange membranes 58, 59 in the assembled electrolytic cell is also shown. It can be seen that the barrier members 33, 56 shield the cation-exchange membranes from gaseous product which may collect in the upper part 35 of the anode compartment of the cell.

Referring to FIG. 5 the cathode 60, which is made of nickel, comprises a frame-like section 61, 73 defining a central opening 62 which is bridged by a plurality of spaced-apart strips 63 which are parallel to each other, which are displaced from and parallel to the plane of the frame-like section 61, 73 and which are displaced to both sides of the plane of the frame-like sections 61, 73. The cathode 60 comprises four openings 64, 65, 66 and 67 which, in the electrolytic cell, form a part of headers through which, respectively, electrolyte is charged to the anode compartments of the electrolytic cell, products of electrolysis are removed from the anode compartments of the cell, water or other liquor is charged to the cathode compartments of the cell, and products of electrolysis are removed from the cathode compartments of the cell. The central opening 62 is connected to the opening 66, and thus to the header through which water or other liquor is charged to the cathode compartments of the cell, via a port device 68, and the central opening 62 is connected to the opening 67, and thus to the header through which products of electrolysis are discharged from the cathode compartments of the cell, via a port device 69. The cathode 60 comprises two further openings 70, 71 which in the electrolytic cell form a part of balancing headers which are in communication with, respectively, the cathode compartments and the anode compartments of the cell. The opening 70, and thus the balancing header of which opening 70 forms a part, is connected via port device 72 to the central opening 62 and thus to the cathode compartments of the cell. The cathode 60 is completed by a projection 74 to which is bolted a copper member 75 through which in operation electrical power is fed to the cathode 60.

Referring to FIG. 6 the gasket 80, which is made of an electrically insulating elastomeric material, comprises a frame-like section 81, 92 defining a central opening 82 and four openings 83, 84, 85, 86 which in the electrolytic cell, form a part of headers through which, respectively, electrolyte is charged to the anode compartments of the electrolytic cell, products of electrolysis are removed from the anode compartments of the cell, water or other liquor is charged to the cathode compartments of the cell, and products of electrolysis are removed from the cathode compartments of the cell. The central opening 82 is connected to the opening 85, and thus to the header through which liquor is charged to the cathode compartments of the cell, via a recess 87, and the central opening 82 is connected to the opening 86, and thus to the header through which products of electrolysis are removed from the cathode compartments of the cell, via a recess 88. The gasket 80 comprises two further openings 89, 90 which in the electrolytic cell form a part of balancing headers which are in communication with, respectively, the cathode compartments and the anode compartments of the cell. The opening 89, and thus the balancing header of which opening 89 forms a part, is connected via recess 91 to the central opening 82 and thus to the cathode compartments of the cell. The gasket 80 also comprises a barrier member 93 which is integral with the frame-like section 92 of gasket 80 and is thus constructed of the same elastomeric material. In operation of the cell the barrier member 93 shields the membranes from the gas which collects at the upper part 117 (see FIG. 8) of the cathode compartments.

Referring to FIG. 7 the gasket 100, which is made of an electrically insulating elastomeric material, comprises a frame-like section 101, 109 defining a central opening 102 and four openings 103, 104, 105, 106 which, in the electrolytic cell, form a part of headers through which, respectively, electrolyte is charged to the anode compartments of the electrolytic cell, products of electrolysis are removed from the anode compartments of the cell, water or other liquor is charged to the cathode compartments of the cell, and products of electrolysis are removed from the cathode compartments of the cell. The gasket 100 comprises two further openings 107, 108 which in the electrolytic cell form a part of balancing headers whih are in communication with, respectively, the cathode compartments and the anode compartments of the cell, and upstanding lips 111, 112, 113, 114, 115, 116 positioned around the openings 103, 104, 105, 106, 107, 108 respectively, the height of these lips from the plane of the gasket being slightly greater than the thickness of the cathode 60.

The gasket 100 also comprises a barrier member 110 which is integral with the frame-like section 109 of gasket 100 and is thus constructed of the same elastomeric material.

The cathode 60, gasket 80 and gasket 100 are assembled by positioning a face of cathode 60 into contact with gasket 80 with port devices 68, 69 and 72 being positioned in recesses 87, 88 and 91 respectively of gasket 80. Gasket 100 is then positioned in contact with the other face of cathode 60 with the upstanding lips 111, 112, 113, 114, 115, 116 being positioned in openings 64, 65, 66, 67, 70, 71, respectively, with the lips being in contact with the face of the gasket 80 thus providing a layer of an electrically insulating matrial around the openings 64, 65, 66, 67, 70, 71.

In order to locate and maintain the gaskets 80, 100 in position in relation to the cathode 60 both the gaskets and the cathode may comprise a plurality of projections and recesses on and in the faces thereof which mate with each other. For simplicity these projections and recesses are not shown.

Referring to FIG. 8, the positions of two cation-exchange membranes 118, 119 in the assembled electrolytic cell is also shown. It can be seen that the barrier members 93, 110 shield the cation-exchange membranes from gaseous product whch may collect in the upper part 117 of the cathode compartment of the cell.

Referring to FIG. 9 the electrolytic cell comprises a plurality of cathode components 120, 121 each of which comprises a cathode and a pair of gaskets positioned on either side of the cathode, as described with reference to FIGS. 5 to 8. The electrolytic cell also comprises a plurality of anode components 122, only one of which is shown, each of which comprises an anode and a pair of gaskets positioned on either side thereof, as described with reference to FIGS. 1 to 4. In the electrolytic cell anode components 122 and cathode components 120, 121 are positioned alternately, and a cation-exchange membrane is attached, for example by means of an adhesive, to the frame-like part of one of the gaskets of each of cathode components 120, 121 and to one of the gaskets of each of the anode components 122 so that in the assembled cell a cation-exchange membrane is positioned between each anode and adjacent cathode. The position of the cation-exchange membranes is indicated by the dotted lines on the cathode components 120, 121 and anode components 122. The electrolytic cell is assembled by including the desired number of anode components 122 and cathode components 120, 121 in the assembly, positioning end plates at the ends of the assembly, and compressing the assembly of anode components and cathode components between the end plates, for example on tie rods. For the sake of simplicity the end plates and the tie rods have not been shown in FIG. 9. Assembly of the electrolytic cell is completed by connecting the headers of which openings 123, 124, 125 and 126 in cathode component 120 form a part to, respectively, a source of electrolyte to be charged to the anode compartments of the cell, means for receiving the products of electrolysis from the anode compartments of the cell, a source of water or other liquor to be charged to the cathode compartments of the cell, and means for receiving the products of electrolysis from the cathode compartments of the cell, and connecting the copper members 127, 128, 129 to a source of electrical power.

In the electrolytic cell the anode compartments are formed by the space between cation-exchange membranes positioned on either side of an anode component 122, and the cathode compartments are formed by the space between cation-exchange membranes positioned on either side of a cathode component 120 or 121.

Operation of the electrolytic cell will be described with reference to the electrolysis of an aqueous sodium chloride solution. Aqueous sodium chloride solution is charged to the header of which opening 123 in cathode component 120 forms a part and thence into the anode compartments of the cell where it is electrolysed. Depleted sodium chloride solution and chlorine produced in the electrolysis pass from the anode compartments into the header of which the opening 124 in the cathode component 120 forms a part, and thence out of the cell.

Water is charged to the header of which the opening 125 in the cathode component 120 forms a part and thence into the cathode compartments of the cell. In the cathode compartments sodium ions transported across the cation-exchange membrane from the anode compartments react with hydroxyl ions formed by electrolysis of water, and sodium hydroxide solution and hydrogen which are formed pass from the cathode compartments through the header of which the opening 126 in the cathode component 120 forms a part, and thence out of the cell.

Distribution of liquors between each of the anode compartments, and between each of the cathode compartments, is assisted by the balancing headers referred to with reference to FIGS. 1 to 3 and 5 to 7 and which are in communication, respectively, with each of the anode compartments and with each of the cathode compartments.

In the electrolytic cell, and referring to FIG. 4, a cation-exchange membrane 58 is positioned in contact with frame-like sections 21, 32 and barrier member 33 of gasket 20, and a cation-exchange membrane 59 is positioned in contact with frame-like sections 41, 49 and barrier member 56 of gasket 40, and in operation of the electrolytic cell gaseous chlorine collects in the upper part of the anode compartment at a position indicated by the numeral 35 in FIG. 4. The barrier members 33 and 56 attached to the gaskets 20 and 40 respectively shield the cation-exchange membranes 58, 59 from contact with this gaseous chlorine.

In the electrolytic cell, and referring to FIG. 8, a cation-exchange membrane 118 is positioned in contact with frame-like sections 81, 92 and barrier member 93 of gasket 80, and a cation-exchange membrane 119 is positioned in contact with frame-like sections 101, 109 and barrier member 110 of gasket 100, and in operation of the electrolytic cell gaseous hydrogen collects in the upper part of the cathode compartment at a position indicated by the numeral 117 in FIG. 8. The barrier members 93 and 110 integral with the gaskets 80 and 100 respectively shield the cation-exchange membranes 118, 119 from contact with this gaseous hydrogen.

I claim:

1. An electrolytic cell comprising a plurality of substantially vertically positioned electrodes and a separator positioned between adjacent pairs of electrodes thereby dividing the cell into a plurality of separate electrode compartments, in which a barrier member is positioned at an upper part of an electrode compartment between an electrode and an adjacent separator which barrier member extends for substantially the full width of the electrode compartment, and which in operation of the electrolytic cell, shields the separator from contact with a gaseous product of electrolysis which may collect in an upper part of the electrode compartment.

2. An electrolytic cell as claimed in claim 1 comprising a plurality of substantially vertically positioned anodes and cathodes and a separator positioned between each anode and adjacent cathode thereby dividing the cell into a plurality of anode compartments and cathode compartments, in which a barrier member is positioned at an upper part of an anode compartment of the cell between an anode and an adjacent separator, or at an upper part of a cathode compartment of the cell between a cathode and an adjacent separator, which barrier member, in operation of the electrolytic cell, shields the separator from contact with a gaseous product of electrolysis which may collect in an upper part of the anode compartment, or in an upper part of the cathode compartment.

3. An electrolytic cell as claimed in claim 1 in which the barrier member has sufficient depth that in operation it shields the separator from substantially all of the gaseous products of electrolysis which may collect in an upper part of the electrode compartment.

4. An electrolytic cell as claimed in claim 1 in which a barrier member is positioned between an anode and an adjacent separator and between a cathode and an adjacent separator.

5. An electrolytic cell as claimed in claim 4 which is a monopolar cell comprising a plurality of alternating anodes and cathodes with a separator positioned between each anode and adjacent cathode.

6. An electrolytic cell as claimed in claim 4 which is a bipolar cell comprising a plurality of bipolar electrodes one face of which functions as an anode and an opposite face of which functions as a cathode and in which a separator is positioned between an anode of one bipolar electrode and a cathode of an adjacent bipolar electrode.

7. An electrolytic cell as claimed in claim 6 which is of the filter press type.

8. An electrolytic cell as claimed in claim 7 which comprises a plurality of anodes, cathodes and frame-like gaskets of an electrically insulating material in which the frame-like gaskets are positioned between each anode and adjacent cathode.

9. An electrolytic cell as claimed in claim 8 in which the anodes and cathodes are positioned in recesses in the frame-like gaskets.

10. An electrolytic cell as claimed in claim 8 or claim 9 in which the frame-like gasket comprises a central opening and the barrier member is positioned across the central opening.

11. An electrolytic cell as claimed in any one of claims 8 to 10 in which gaskets are resilient.

* * * * *